US011530624B2

(12) United States Patent
Sassmannshausen et al.

(10) Patent No.: US 11,530,624 B2
(45) Date of Patent: Dec. 20, 2022

(54) TOOL FOR MOUNTING THE HIGH-PRESSURE SHAFT OF AN AIRCRAFT ENGINE

(71) Applicant: Lufthansa Technik AG, Hamburg (DE)

(72) Inventors: Jan Sassmannshausen, Hamburg (DE); Eugen Roppelt, Hamburg (DE)

(73) Assignee: LUFTHANSA TECHNIK AG, Hamburg (DE)

( * ) Notice: Subject to any disclaimer, the term of this patent is extended or adjusted under 35 U.S.C. 154(b) by 0 days.

(21) Appl. No.: 17/613,497

(22) PCT Filed: May 22, 2020

(86) PCT No.: PCT/EP2020/064253
§ 371 (c)(1),
(2) Date: Nov. 23, 2021

(87) PCT Pub. No.: WO2020/239620
PCT Pub. Date: Dec. 3, 2020

(65) Prior Publication Data

US 2022/0243619 A1 Aug. 4, 2022

(30) Foreign Application Priority Data

May 24, 2019 (DE) ..... 10 2019 114 029.3

(51) Int. Cl.
*B25B 1/00* (2006.01)
*F01D 25/28* (2006.01)
*B25B 27/14* (2006.01)

(52) U.S. Cl.
CPC ..... *F01D 25/285* (2013.01); *B25B 27/14* (2013.01); *F05D 2230/72* (2013.01);
(Continued)

(58) Field of Classification Search
CPC ..... F01D 25/285; F01D 25/28; F01D 25/16; Y10T 29/53843; Y10T 29/53861;
(Continued)

(56) References Cited

U.S. PATENT DOCUMENTS 2,641,831 A * 6/1953 Helton ..... B25B 27/02 29/255
8,127,417 B1 * 3/2012 Butler ..... B25B 27/06 29/281.1

(Continued)

FOREIGN PATENT DOCUMENTS

EP 3106756 A1 12/2016

*Primary Examiner* — Joseph J Hail
*Assistant Examiner* — Arman Milanian
(74) *Attorney, Agent, or Firm* — Leydig, Voit & Mayer, Ltd.

(57) ABSTRACT

A tool holds and axially fixes a high-pressure shaft of an aircraft engine in a state where a high-pressure turbine stage is demounted. The tool includes: a shaft end cap having an inner radius, which is adapted to a predetermined shaft diameter, the shaft end cap plugs onto a turbine-side end of the high-pressure shaft; a shaft end cap receptacle receives the shaft end cap in a radially movable manner and in an axially limited manner in a first direction; a connector is fastenable to the shaft end cap receptacle and has a shank, which is insertable into the high-pressure shaft, the connector being configured to axially secure the shaft end cap receptacle; and a spring element, which is positionally fixed with respect to the shaft end cap receptacle, the spring element being configured to apply a predetermined spring force to the shaft end cap in the radial direction.

13 Claims, 5 Drawing Sheets

(52) U.S. Cl.
CPC ..... *F05D 2260/02* (2013.01); *F05D 2260/38* (2013.01); *F05D 2300/432* (2013.01)

(58) Field of Classification Search
CPC ..... Y10T 29/53; Y10T 29/53878; Y10T 29/49318; Y10T 29/4932; Y10T 29/49815; Y10T 29/53796; Y10T 29/53943; Y10T 29/53961; F05D 2230/80; F05D 2260/83; F05D 2230/72; F05D 2260/02; F05D 2260/36; F05D 2300/432; F23R 3/60; B23P 19/025; B23P 19/04; B25B 11/00; B25B 27/00; B25B 27/14
See application file for complete search history.

(56) References Cited

U.S. PATENT DOCUMENTS

| | | | | |
|---|---|---|---|---|
| 8,528,192 | B2 * | 9/2013 | Jayko | H02K 15/0006 29/735 |
| 9,638,106 | B2 * | 5/2017 | Müller | F16C 35/00 |
| 2012/0151735 | A1 * | 6/2012 | Thomas | B25B 27/062 29/283 |
| 2016/0265440 | A1 * | 9/2016 | Jorgensen | F02C 7/20 |
| 2016/0363323 | A1 * | 12/2016 | Mogle | F23R 3/60 |

* cited by examiner

TOOL FOR MOUNTING THE HIGH-PRESSURE SHAFT OF AN AIRCRAFT ENGINE

CROSS REFERENCE TO RELATED APPLICATIONS

This application is a U.S. National Phase application under 35 U.S.C. § 371 of International Application No. PCT/EP2020/064253, filed on May 22, 2020, and claims benefit to German Patent Application No. DE 10 2019 114 029.3, filed on May 24, 2019. The International Application was published in German on Dec. 3, 2020 as WO 2020/239620 A1 under PCT Article 21(2).

FIELD

The invention relates to a tool for holding and axially fixing the high-pressure shaft of an aircraft engine, with the high-pressure turbine stage demounted, and to the use thereof.

BACKGROUND

During the maintenance, repair, or improvement of aircraft engines individual components and modules are demounted from the engine, and, after separate processing, the components can be remounted. If the aircraft engine is not completely disassembled, it is frequently not possible for arbitrary components or modules to be demounted on account of the lightweight design, which is typical in aircraft engines, and the associated omission of a separate supporting structure. This is because the components and modules of an aircraft engine are connected to one another in such a way that they support one another or are mounted in one another, thereby making it possible to dispense with a separate supporting structure, as is known of other, in particular stationary, machines and to which components and modules are individually releasably fastened.

An example of this, in addition to a large number of further engine types, is the engine type V2500 manufactured by International Aero Engines (IAE). In the case of this aircraft engine, the high-pressure shaft is mounted on one side in a nonrotating front bearing compartment with a fixed bearing, which is configured as a rolling bearing and which is arranged upstream of the high-pressure compressor module. On the other side, a further rolling bearing, such as a floating bearing, is provided in the region of the combustion chamber, and thus, upstream of the high-pressure turbine module. If only the front bearing compartment is removed, for example for maintenance purposes, the axial securement of the high-pressure shaft is effected solely by a retainer mounted on the high-pressure turbine module. If only the high-pressure turbine module is removed, the axial securement is effected exclusively by the fixed bearing of the front bearing compartment.

For the V2500 engine mentioned by way of example, but also in a large number of other aircraft types, it is the case that, if the engine is not completely disassembled, no admissible construction state is defined in which both the front bearing compartment and the high-pressure turbine module are demounted. As a result, maintenance and repair work on the two aforementioned components can occur only sequentially, with the result that the processing time for an engine can increase considerably.

SUMMARY

In an embodiment, the present disclosure provides a tool that holds and axially fixes a hollow high-pressure shaft of an aircraft engine, in a state where a high-pressure turbine stage is demounted. The tool includes: a shaft end cap having an inner radius, which is adapted to a predetermined shaft diameter, the shaft end cap being configured to plug onto a turbine-side end of the hollow high-pressure shaft; a shaft end cap receptacle configured to receive the shaft end cap in a radially movable manner and in an axially limited manner in a first direction; a connector which is fastenable to the shaft end cap receptacle and which has a shank, which is insertable into the hollow high-pressure shaft, the connector being configured to axially secure the shaft end cap receptacle; and a spring element, which is positionally fixed with respect to the shaft end cap receptacle, the spring element being configured to apply a predetermined spring force to the shaft end cap in the radial direction.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
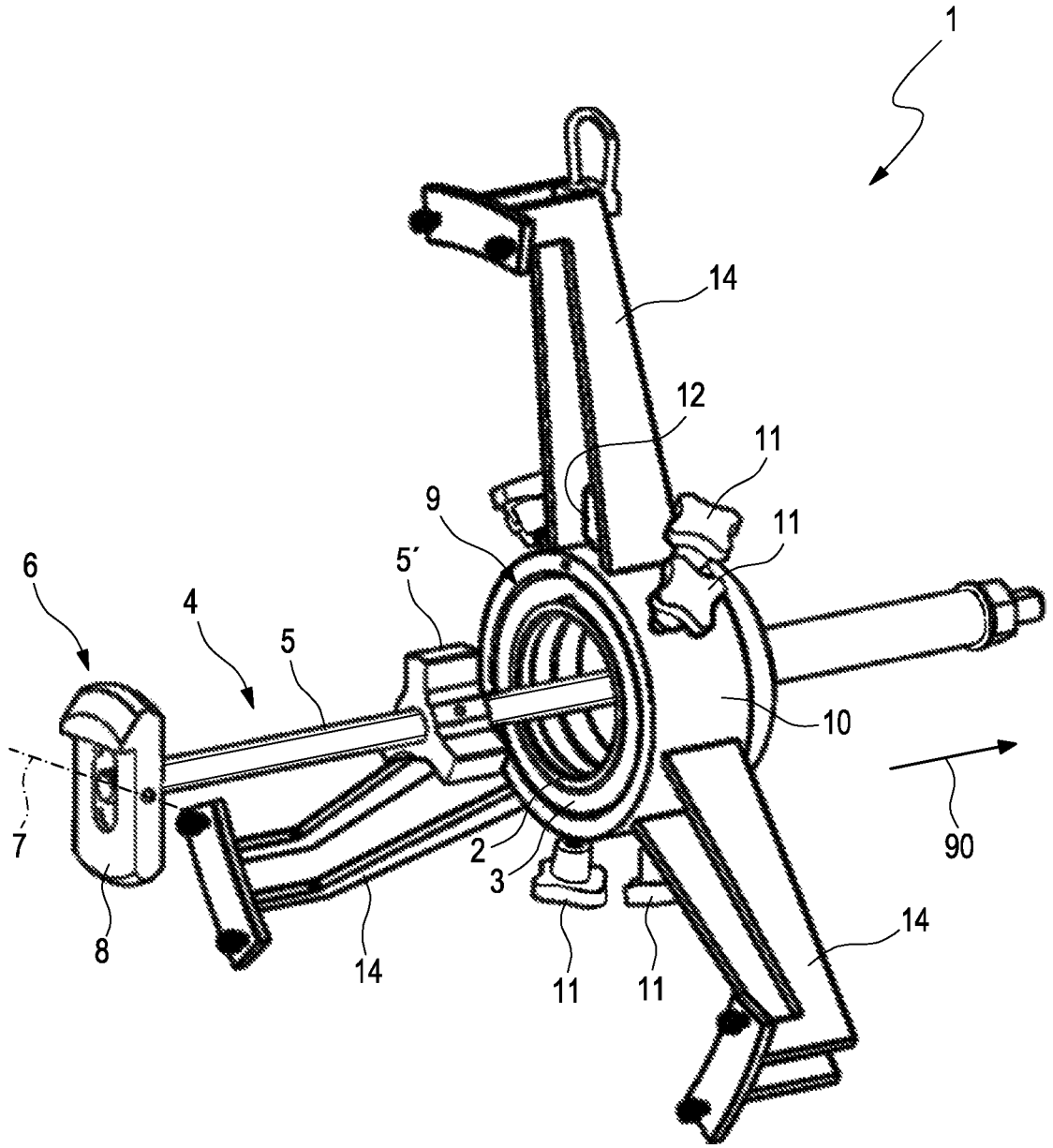
FIG. 1 shows a first exemplary embodiment of a tool according to an aspect of the invention.

Aspects of the present invention provide for a tool and the use of this tool by means of which the disadvantages of the prior art can be avoided or at least reduced.

Accordingly, an aspect of the invention relates to a tool for holding and axially fixing the hollow high-pressure shaft of an aircraft engine, with the high-pressure turbine stage demounted, including:

- a shaft end cap element having an inner radius, which is adapted to a predetermined shaft diameter, for plugging onto the turbine-side end of the high-pressure shaft,
- a shaft end cap receptacle for receiving the shaft end cap element in a radially movable manner and in an axially limited manner in a first direction,
- a connector element, which can be fastened to the shaft end cap receptacle and which has a shank, which can be introduced into the high-pressure shaft, comprising a fixing element for axially securing the shaft end cap receptacle, wherein:
- a spring element, which is positionally fixed with respect to the shaft end cap receptacle, for applying a predetermined spring force to the shaft end cap element in the radial direction is provided.

Furthermore, an aspect of the invention relates to the use of the tool according to the invention, comprising the following steps:

a) demounting the high-pressure turbine stage(s) of the aircraft engine;

b) plugging the shaft end cap element onto the turbine-side end of the high-pressure shaft;

c) introducing the shank of the connector element with the fixing element into the high-pressure shaft;

d) mounting the shaft end cap receptacle around the shaft end cap element;

e) connecting the connector element to the shaft end cap receptacle such that the shaft end cap receptacle is axially fixed by the fixing element of the connector element; and f) applying a spring force to the shaft end cap element in the radial direction by means of the spring element which is positionally fixed with respect to the shaft end cap receptacle.

By means of the tool according to an aspect of the invention, it is possible for the high-pressure shaft of an aircraft engine, with the high-pressure turbine stage demounted, to be completely secured in the axial direction and at the same time to be held in the radial direction via the spring element in such a way that, by way of the predetermined spring force, the weight force acting on the high-pressure shaft with the high-pressure turbine stage mounted can be simulated. The high-pressure shaft is thus not completely fixed in the radial direction, but is loaded only with a spring force corresponding to said weight force, whereby the shaft is held, on the one hand, in the required, desired position but, on the other hand, no undesired stresses are introduced into the high-pressure shaft by a fixed bearing at the rear end of said shaft.

The axial securement is effected by the interaction of the shaft end cap receptacle, which prevents a movement of the high-pressure shaft with fitted shaft end cap element as a result of the axial limitation in the first direction, in particular for example in the direction of the shaft end cap element, and a shank connected thereto which, by way of its fixing element, can prevent an axial movement of the high-pressure shaft with respect to the shaft end cap receptacle counter to the first direction (for example away from the shaft end cap element).

The high-pressure shaft can thus be completely fixed in the axial direction with respect to the shaft end cap receptacle, whereas only a predetermined force is exerted in the radial direction, but in principle the high-pressure shaft can move somewhat with respect to the shaft end cap receptacle in the radial direction, at least in principle, since in particular there is no fixed bearing in this direction. With the fixing of the shaft end cap receptacle there thus occurs the desired holding and axial fixing of the high-pressure shaft of an aircraft engine.

It is preferable if the spring element is adjustable in terms of the spring force. As a result, the spring force which is predetermined for a certain engine, a certain engine variant (that is to say one of a plurality of variants of an engine type) and/or a certain engine type can be adjusted. It may also be possible, where appropriate, for the spring force to be readjusted if required when the tool is in a mounted state on an engine.

The fixing element on the shank of the connector element can in principle be designed for force-fitting connection to the inner side of the hollow high-pressure shaft. However, it is preferably designed for form-fitting connection to the high-pressure shaft. For this purpose, the fixing element can interact with undercuts, which are regularly present in high-pressure shafts of an aircraft turbine, as a result of an inner diameter which changes in the axial direction.

Thus, the fixing element can be, for example, a lock which is arranged on the free shank end to be introduced into the high-pressure shaft and which extends on both sides of the shank and which is preferably pivotable perpendicularly to its longitudinal axis and/or to the axis of the shank. In the pivoted state, the fixing element can be introduced into the hollow high-pressure shaft, whereas, in the unpivoted state, the lock extends to a maximum in the radial direction and can thus interact with a bearing surface in the interior of the hollow shaft.

For actively pivoting the lock there can be provided an actuating device, for example a wire pull. However, it is particularly preferable if the lock has an asymmetrical weight distribution with respect to the shank. In this case, it is possible just by rotating the shank for the lock to be moved into a vertical orientation or an orientation in which it is pivoted with respect to the shank.

It is possible to position or fix the tool according to an aspect the invention with respect to the aircraft engine in particular by means of stands or holders. However, it is preferable if the tool is fastened directly to the aircraft engine, thereby practically ruling out the risk of damage as a result of relative movements between the tool and aircraft engine.

In a preferred embodiment, a fastening element for positionally fixedly fastening the tool to the aircraft engine, with the high-pressure turbine stage demounted, having a fastening region for fastening the shaft end cap receptacle thereto is provided. For example, the fastening element can be configured to fasten the tool to a flange of the combustion chamber. The releasable fastening of the tool can be achieved, for example, with screws.

The fastening element is preferably to be fastened to the aircraft engine in a predetermined position. For this purpose, the fastening region can preferably be configured in such a way that the tool can in fact be fastened to the engine only in a single predetermined position. This can be achieved, for example, in that the fastening region, and in particular bores provided thereon for the engagement of screws, are adapted in an accurately fitting manner to the fastening points provided on the engine. Particularly if the spring element is at least also arranged on or fastened to the fastening element, it is possible, by corresponding correct fastening of the tool to the aircraft engine, to achieve a predetermined orientation of the spring element in order thereby to be able to simulate weight forces, for example.

It is preferable if the bearing and/or contact surfaces of the shaft end cap element and/or of the fixing element which are provided for contact with the high-pressure shaft are made from a material which is softer than the material of the high-pressure shaft, preferably from plastic, more preferably from PTFE. As a result, damage to the high-pressure shaft when using the tool according to an aspect the invention can be effectively prevented.

It can be advantageous to in each case provide a tool according to an aspect the invention for each desired engine type that is then in each case precisely tailored to the engine type. Thus, the fastening region can be precisely adapted to the respectively provided fastening points of an engine type, and the relative position and curvature of the shaft bearing element can be precisely adapted to the high-pressure shaft of the engine type. This simplifies the use of a tool according to an aspect the invention, since no particular engine-specific adjustments have to be carried out on the tool.

For the use of the tool according to an aspect the invention, first of all the high-pressure turbine of an aircraft engine is demounted. Consequently, the rear end of the high-pressure shaft projects out of the engine. In this state, the axial fixing of the high-pressure shaft still occurs by means of the fixed bearing of the high-pressure shaft which, for example, is provided in a front bearing compartment close to the high-pressure compressor.

In a possible use variant, the shaft end cap element is then first of all plugged onto the turbine-side end of the high-pressure shaft, and the shank of the connector element with the fixing element is introduced into the high-pressure shaft. The shaft end cap receptacle is then mounted around the shaft end cap element and connected to the shank of the connector element, with the connector element having been connected to the high-pressure shaft by the fixing element, in such a way that the parts of the tool according to an aspect the invention that are mounted on the high-pressure shaft are positionally fixed with respect to the high-pressure shaft in the axial direction.

By suitable fastening of the shaft end cap receptacle, the high-pressure shaft can then be fixed with respect to the engine in the axial direction, with a certain movability in the radial direction remaining as a result of the movability of the shaft end cap element and of the shaft end cap receptacle. However, by means of the spring element which is positionally fixed with respect to the shaft end cap receptacle, it is possible, where required, for a predetermined spring force to be exerted in the radial direction onto the shaft end cap element and thus the high-pressure shaft.

The fastening of the shaft end cap receptacle can preferably be achieved by a fastening element as has been described above and which allows a positionally fixed fastening to the engine itself. Here, during the fastening of the shaft end cap receptacle, the spring element has preferably not yet been mounted, but is mounted only later.

The fastening element is fastened, with the means provided therefor, to the engine, for example to the combustion chamber flange, in such a way that the fastening region of the fastening element is suitably arranged for fastening the shaft end cap receptacle thereto. There then occurs the fastening of the shaft end cap receptacle to the fastening region, preferably in an axially and/or radially variable manner, that is to say that the shaft end cap receptacle and fastening region do not have a fixedly defined relative position with respect to one another for the fastening, but can be connected to one another while being displaced relative to one another in the axial and/or radial direction. The connection or fastening can occur in a force-fitting manner.

After the fastening of the shaft end cap receptacle to the combustion chamber flange has occurred, a predetermined spring force can be applied to the shaft end cap element in the radial direction by means of the spring element that has already been mentioned, in particular in order to simulate the weight force of the high-pressure turbine otherwise acting on the high-pressure shaft. Here, the spring element can preferably be arranged on or connected to the fastening element.

As a result of the retention of the high-pressure shaft that has been achieved by means of the tool, it is then possible, for example, for the fixed bearing of the high-pressure shaft to be demounted. Here, to prevent sagging of the front part of the high-pressure shaft, it is possible beforehand for a temporary radial support to be mounted on the high-pressure shaft in the region remote from the tool. Corresponding supports, which form an additional floating bearing for the high-pressure shaft, are available for a large number of different engine types.

Figure 2:
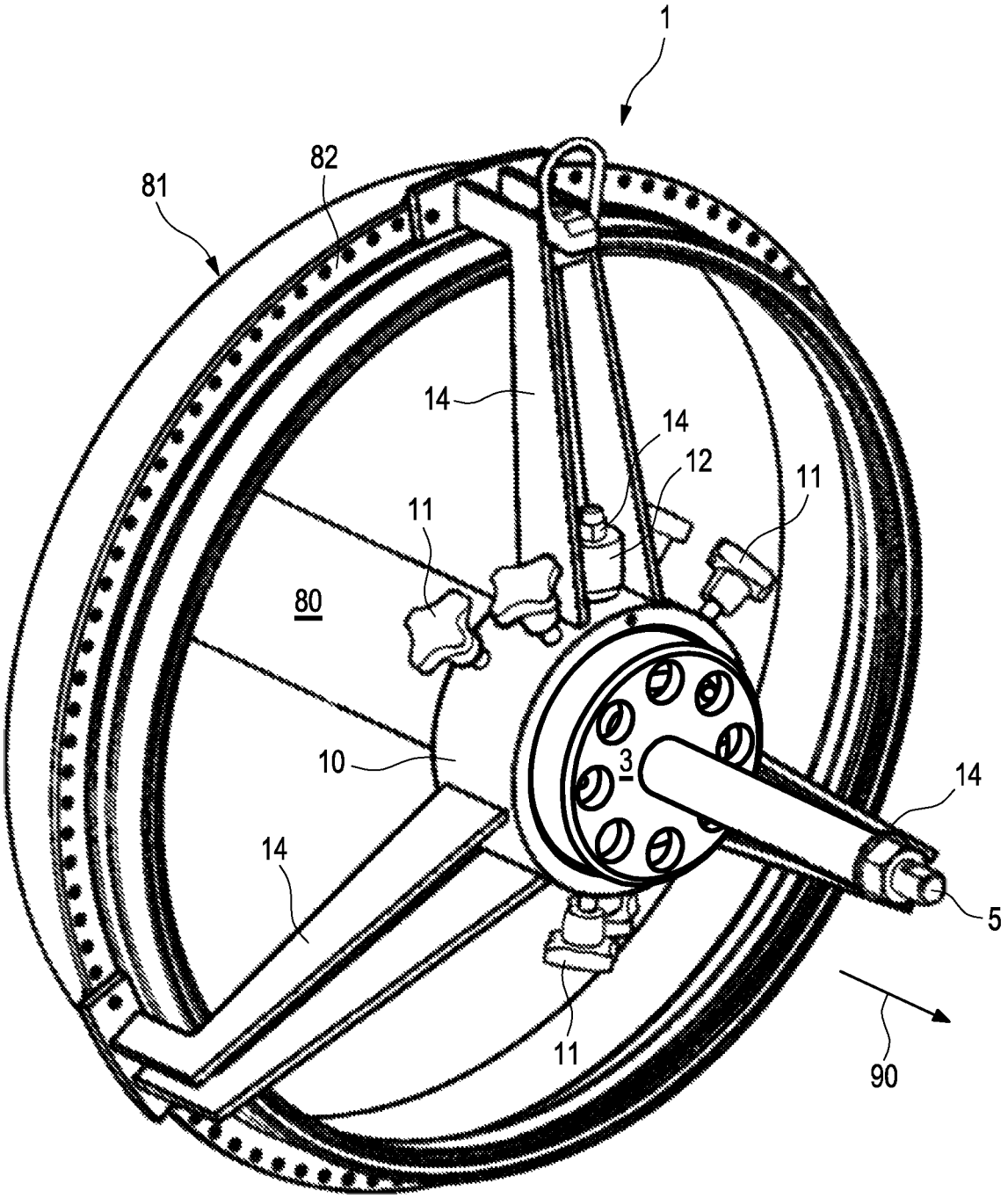
FIG. 2 shows a schematic illustration of the tool according to FIG. 1 as used according to an aspect the invention.

FIG. 1 illustrates a first exemplary embodiment of a tool 1 according to an aspect the invention, wherein the individual components of the tool which will be explained below are assembled. In FIG. 2, the tool 1 is illustrated in the use state. FIG. 3*e* shows ultimately a section through the tool 1 in the use state according to FIG. 2. In addition to the tool 1 or its components, FIGS. 2 and 3 also indicate parts of an aircraft engine, namely the rear end of the high-pressure shaft 80 and also the end region of the combustion chamber 81 with a peripheral flange 82.

The tool 1 comprises a shaft end cap element 2 whose inside diameter is adapted to the diameter of the turbine-side end of the high-pressure shaft of an aircraft engine for which the tool 1 is provided. The shaft end cap element 2 can be separated from the remaining components of the tool 1 and is configured in such a way that it can be plugged onto the relevant end of the high-pressure shaft.

In the mounted state of the tool, the shaft end cap element 2 is arranged in a shaft end cap receptacle 3 which limits or prevents a movement of the shaft end cap element 2 in the first direction indicated by the arrow 90 but which at the same time allows a radial movement of the shaft end cap element 2 to a certain degree. For this purpose, the inner radius of the shaft end cap receptacle 3, which is also configured in the form of a cap in this exemplary embodiment, is larger than the outer radius of the shaft end cap element 2.

To the shaft end cap receptacle 3 there is releasably fastened a connector element 4 having a shank 5, which can be introduced into the high-pressure shaft, comprising a fixing element 6 for axially securing the shaft end cap receptacle 3.

Here, as will be explained below by way of FIG. 3, the fixing element 6 is designed for form-fitting connection to the high-pressure shaft 80 as a lock 8 which is pivotable about the axis 7, extends on both sides of the shank 5 and has an asymmetrical weight distribution with respect to the shank 5. Precisely on account of this asymmetrical weight distribution in which the center of gravity of the lock 8 in vertical orientation is situated below or above the axis 7 depending on the rotation of the shank 5 of variable orientation, the lock 8 moves either into the position for axial fixing as illustrated in FIG. 1 or into an angled position with respect to the shank 5 in which the connector element 4 can be inserted into or removed again from a high-pressure shaft of an engine.

On the shank 5 there is also provided a guide element 5' made of soft plastic by means of which it is ensured that the shank 5 itself does not come into contact with the inner wall of the high-pressure shaft 80 and can possibly cause any damage there.

The shaft end cap receptacle 3 is fastened to the fastening region 9 of a fastening element 10. Here, the fastening region 9 is configured in the form of a sleeve or bushing and adapted to the outside diameter of the shaft end cap receptacle 3 in such a way that the latter can be fastened variably not only axially in the fastening region 9 but also, to a certain extent, in the radial direction. For this purpose, the shaft end cap receptacle 3 has a certain degree of play with respect to the fastening region 9 before it can be fixed by the screws 11 in the desired axial and radial position.

On the fastening element 10 there is also arranged a spring element 12 which, after fixing of the shaft end cap receptacle 3 to the fastening element 10 has occurred, is positionally fixed with respect thereto. The spring element 12 projects through the shaft end cap receptacle 3 and is designed to apply its spring force to the shaft end cap element 2 in the radial direction (cf. FIG. 3). The spring element 12 is adjustable, via the setting screw 13, in terms of the spring force exerted onto the shaft end cap element 2.

The fastening element 10 has three extension arms 14 for fastening to the flange 82 of the combustion chamber 81 of an aircraft engine (cf. FIG. 2). Here, the extension arms 14 are arranged and designed in such a way that the fastening element 10 can be fastened to the aircraft engine only in one predetermined position. Owing to this definitive position in the mounted state, it can be ensured that the spring element 12 arranged on the fastening element 10 is oriented vertically in the mounted state and can simulate a weight force of a high-pressure turbine stage that otherwise acts on the turbine-side end.

The components which come into direct contact with the high-pressure shaft during the use of the tool 1, namely the shaft end cap element 2 and fixing element 6, are completely made of plastic or are provided, at least on the corresponding contact surfaces, with a plastic layer. Since plastic, such as, for example, PTFE, is generally softer than the material of the high-pressure shaft, any damage to the high-pressure shaft can be effectively avoided.

By way of FIGS. 3*a-e* there will now be explained, by way of example, the mounting of the tool 1 according to FIG. 1 in order to achieve the use state shown in FIG. 2.

Figure 3A:
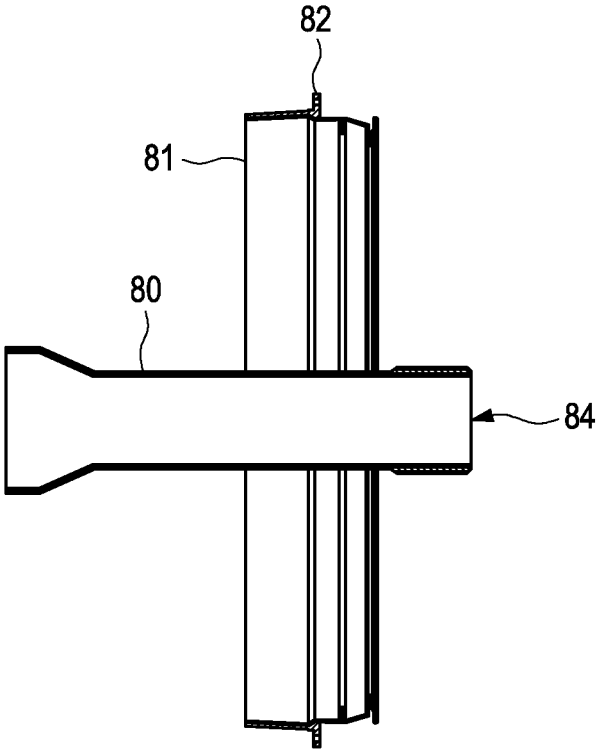
FIGS. 3*a*-3*e* show schematic illustrations of the use of the tool from FIG. 1 for achieving the state illustrated in FIG. 2.

In FIG. 3*a*, the high-pressure turbine stage(s) is/are demounted from an aircraft engine, of which only the rear part of the high-pressure shaft 80 and the end region of the combustion chamber 81 are illustrated, with the result that the turbine-side end 84 of the high-pressure shaft 80 is exposed.

Figure 3B:
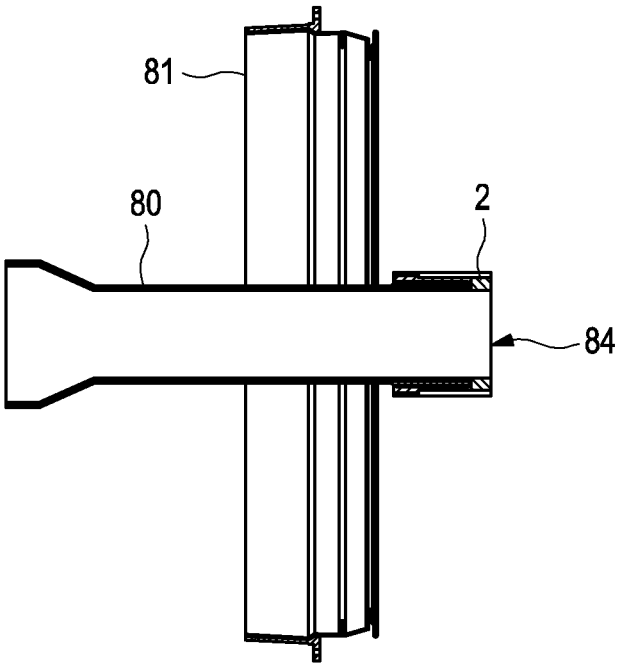

The shaft end cap element 2 is plugged onto this exposed end 84 of the high-pressure shaft 80 (FIG. 3*b*). On account of its inner radius which is adapted to the diameter of the high-pressure shaft 80, the shaft end cap element 2 is seated securely on the high-pressure shaft 80, wherein the cap shape ensures that the shaft end cap element 2 also in fact remains on the turbine-side end 84 of the high-pressure shaft 80.

Figure 3C:
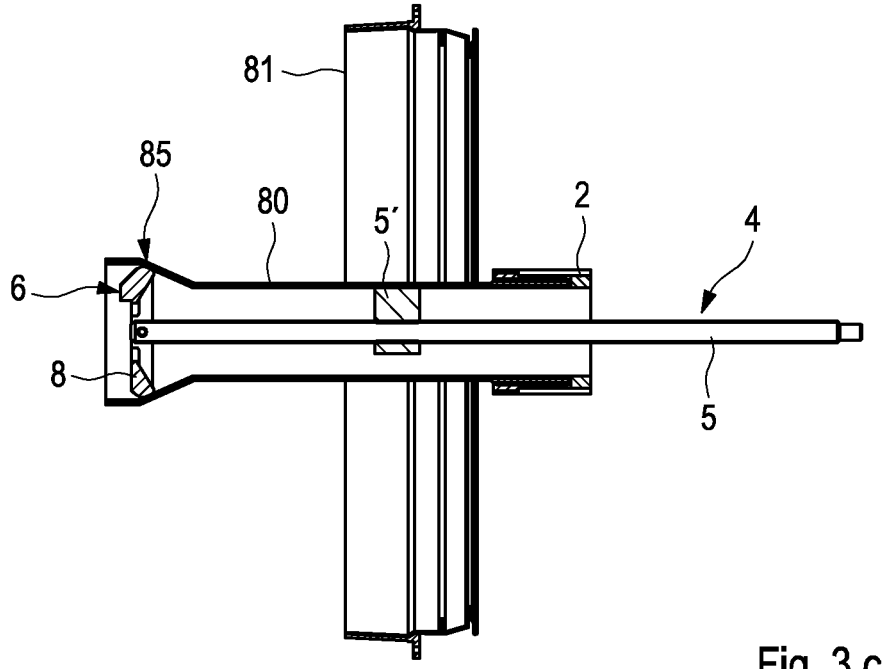

The shank 5 of the connector element 4 is then introduced into the high-pressure shaft 80 to such an extent that the fixing element 6 is situated in a region 85 of the high-pressure shaft 80 in which the shaft diameter is increased (FIG. 3*c*). By suitably rotating the shank 5 about its longitudinal axis it is then possible, on account of the unequal weight distribution of the fixing element 6 designed as a lock 8, to achieve an orthogonal orientation with respect to the shank 5 in which the fixing element 6 can no longer be pulled out through the high-pressure shaft 80, but rather forms a form-fitting connection with the undercut resulting in the region 85 of the diameter increase of the high-pressure shaft 80.

The shank 5 is held away from the inner wall of the high-pressure shaft 80 by the guide element 5'.

Figure 3D:
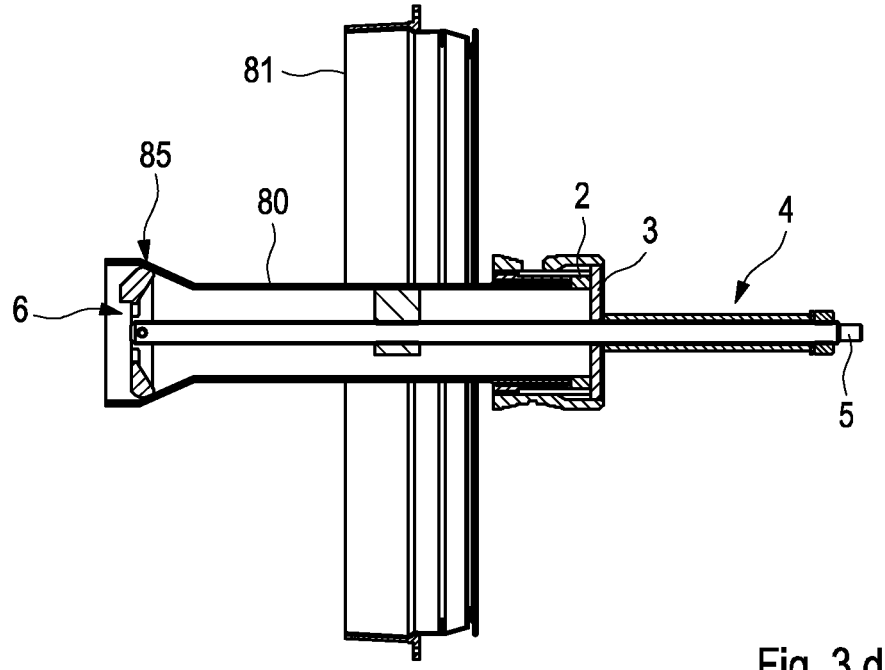
Figure 3E:
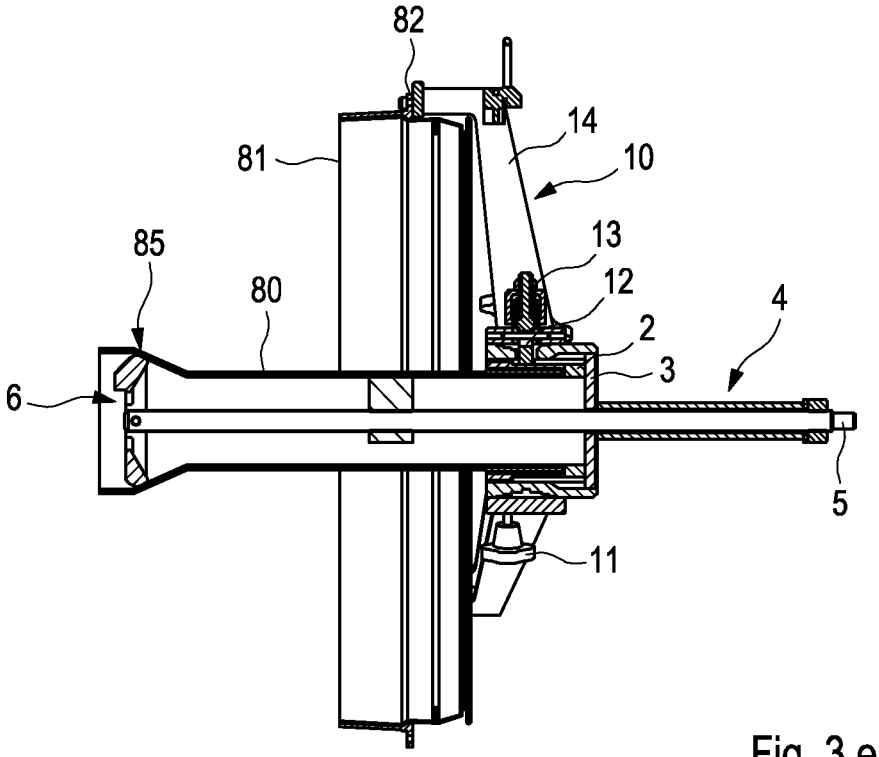

In the next step, the shaft end cap receptacle 3 is mounted around the shaft end cap element 2 and the connection between the shank 5 of the connector element 4 is produced (FIG. 3*d*). By sufficient bracing of the shaft end cap receptacle 3 and connector element 4, the already mounted components 2-4 of the tool 1 can be fixed with respect to the high-pressure shaft 80 in the axial direction: an axial movement of the shaft end cap element 2 with respect to the high-pressure shaft 80 is prevented by the correspondingly limiting shaft end cap receptacle 3 which in turn is fixed in the axial direction by the bracing with the connector element 4.

In spite of this axial fixing, at least relatively small relative movements of the shaft end cap element 2 with respect to the shaft end cap receptacle 3 continue to be possible in the radial direction.

Finally, the fastening element 10 is mounted (FIG. 3*e*). For this purpose, the fastening element 10 is fastened via the extension arms 14 in the only possible position to the rear flange 82 of the combustion chamber 80, to which otherwise at least one high-pressure turbine stage is fastened. In this state, the shaft end cap receptacle 3 is situated within the fastening region 9 and can be finely positioned therein until it is fixed in the desired position by the screws 11.

The spring element 12 provided on the fastening element 10 can then be finely adjusted via the setting screw 13, with the result that a predetermined spring force is exerted onto the shaft end cap element 2 which continues to be radially movable in principle, said spring force simulating the weight force of the high-pressure turbine stage(s) otherwise mounted at this point.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A tool for holding and axially fixing a hollow high-pressure shaft of an aircraft engine, with the high-pressure turbine stage demounted, comprising:

a shaft end cap element having an inner radius, which is adapted to a predetermined shaft diameter, for plugging onto a turbine-side end of the high-pressure shaft;

a shaft end cap receptacle for receiving the shaft end cap element in a radially movable manner and in an axially limited manner in a first direction;

a connector element which can be fastened to the shaft end cap receptacle and which has a shank, which can be inserted into the high-pressure shaft, comprising a fixing element for axially securing the shaft end cap receptacle, wherein a spring element, which is positionally fixed with respect to the shaft end cap receptacle, for applying a predetermined spring force to the shaft end cap element in the radial direction is provided.

2. The tool as claimed in claim 1, wherein the spring element is adjustable in terms of the spring force.

3. The tool as claimed in claim 1, wherein the fixing element is designed for form-fitting connection to the high-pressure shaft.

4. The tool as claimed in claim 1, wherein the fixing element is a pivotable lock which extends on both sides of the shank.

5. The tool as claimed in claim 4, wherein the lock has an asymmetrical weight distribution with respect to the shank.

6. The tool as claimed in claim 1, comprising a fastener configured to positionally fixedly fasten the tool to the aircraft engine, with the high-pressure turbine stage demounted, having a fastening region for fastening the shaft end cap receptacle thereto.

7. The tool as claimed in claim 6, wherein the fastening region or the shaft end cap receptacle is designed for fastening the shaft end cap receptacle in an axially or radially variable manner with respect to the fastening region.

8. The tool as claimed in claim 6, wherein the fastener is designed for fastening to a flange of the combustion chamber of the aircraft engine.

9. The tool as claimed in claim 6, wherein the fastener is configured in such a way that it is configured to be fastened to the aircraft engine only in a single predetermined position.

10. The tool as claimed in claim 1, wherein the bearing or contact surfaces of the shaft end cap or of the connector which are provided for contact with the hollow high-pressure shaft are made from a material which is softer than a material of the hollow high-pressure shaft.

11. A method of operating the tool as claimed in claim 1 for holding and axially fixing the hollow-high-pressure shaft of the aircraft engine, the method comprising:

a) demounting the high-pressure turbine stage of the aircraft engine;

b) plugging the shaft end cap element onto the turbine-side end of the high-pressure shaft;

c) introducing the shank of the connector element with the fixing element into the high-pressure shaft;

d) mounting the shaft end cap receptacle around the shaft end cap element;

e) connecting the connector element to the shaft end cap receptacle such that the shaft end cap receptacle is axially fixed by the fixing element of the connector element; and f) applying a spring force to the shaft end cap element in the radial direction by the spring element which is positionally fixed with respect to the shaft end cap receptacle.

12. The tool as claimed in claim 1, wherein the bearing or contact surfaces of the shaft end cap or of the connector which are provided for contact with the hollow high-pressure shaft are made from a plastic material which is softer than a material of the hollow high-pressure shaft.

13. The method as claimed in claim 11, wherein to fix the tool in the axial direction with respect to the aircraft engine, a fastener which is configured to be fastened to the aircraft engine and which has a fastening region for fastening the shaft end cap receptacle thereto is provided.

* * * * *